United States Patent [19]

Sutton

[11] Patent Number: 5,030,062

[45] Date of Patent: Jul. 9, 1991

[54] CENTRIFUGAL PUMP

[75] Inventor: Michael Sutton, Sussex, Great Britain

[73] Assignee: APV UK Limited, Great Britain

[21] Appl. No.: 511,621

[22] Filed: Apr. 20, 1990

Related U.S. Application Data

[63] Continuation of Ser. No. 300,092, Jan. 18, 1989, abandoned.

[30] Foreign Application Priority Data

May 19, 1987 [GB] United Kingdom ..... 8711732

[51] Int. Cl.[5] ..... F04D 1/00; F04D 5/00

[52] U.S. Cl. ..... 415/204; 415/206; 415/207; 415/214.1

[58] Field of Search ..... 415/203, 206, 207, 204, 415/213.1, 214.1

[56] References Cited

U.S. PATENT DOCUMENTS

| | | | |
|---|---|---|---|
| 2,371,250 | 3/1945 | Maroney | 415/168.2 |
| 4,155,959 | 5/1979 | Blum | 415/207 |
| 4,649,653 | 3/1987 | Ameling | 415/169.2 |

FOREIGN PATENT DOCUMENTS

| | | | |
|---|---|---|---|
| 157511 | 3/1953 | Australia | 415/214 |
| 0032348 | 7/1981 | European Pat. Off. . | |
| 924188 | 2/1955 | Fed. Rep. of Germany . | |
| 2047501 | 3/1972 | Fed. Rep. of Germany . | |
| 341305 | 1/1931 | United Kingdom . | |
| 589689 | 6/1947 | United Kingdom . | |
| 1013341 | 12/1965 | United Kingdom . | |
| 1116817 | 6/1968 | United Kingdom . | |
| 1339986 | 12/1973 | United Kingdom . | |
| 1418055 | 12/1975 | United Kingdom . | |
| 1481423 | 7/1977 | United Kingdom . | |
| 2083866 | 3/1982 | United Kingdom . | |

*Primary Examiner*—Edward K. Look
*Assistant Examiner*—Hoang Nguyen
*Attorney, Agent, or Firm*—Thomas E. Sisson

[57] ABSTRACT

A centrifugal pump having a two member casing in which a first member with a circular peripheral inner wall incorporates a discharge branch and the other member is shaped in such a way as to determine the shape of the volute of the pump when the two members are brought together. The first casing member has a flange extending transversely from the peripheral wall. The second casing has a flat surface for abutment against the flange to seal the two members. The second casing member has a centrally raised section in which the radius of the section varies circumferentially so that the flow area of the volute of the pump varies circumferentially within the pump.

2 Claims, 2 Drawing Sheets

CENTRIFUGAL PUMP

This is a continuation of co-pending application Ser. No. 300,092, filed on Jan. 18, 1989, now abandoned.

BACKGROUND OF THE INVENTION

This invention relates to improvements in centrifugal pumps.

Presently the shape of the volute of a centrifugal pump is determined by the internal shape of the pump casing which is integrally manufactured together with the discharge branch. For the pump to be efficient it is necessary for the fluid to be transported smoothly from the outlet of the impeller to the discharge branch. For pumps handling edible and potable products it is important for the internal surfaces to the pump to have a good surface finish but it is generally difficult and expensive to machine finish the interior surfaces of such a pump because of the integral shapes of the members which make up the pump.

It is an object of the present invention to provide a centrifugal pump which ameliorates the aforementioned disadvantages.

SUMMARY OF THE INVENTION

According to the present invention there is provided a centrifugal pump having a casing comprising two members in which one member with a circular peripheral inner wall incorporates a discharge branch and the other member is shaped in such a way as to determine the shape of the volute of the pump when the two members are brought together.

Preferably, the pump has an inlet which is central to the pump casing.

A first casing member which incorporates the discharge branch may have a flange extending transversely from the peripheral wall. The inside surface is preferably cup-shaped. A second casing member preferably has a flat surface for abutment against the flange of the first casing member, which allows a seal to be formed between the two members.

The second casing member preferably has a centrally raised section in which the radius of the section varies circumferentially so that the flow area of the volute of the pump varies circumferentially within the pump. The flow area of the volute may alternatively be varied due to a circumferential variation in the length of the section, in a direction parallel to the axis of the impeller.

Preferably, the inlet of the pump is in the first casing member incorporating the discharge branch and the impeller is mountable on the other casing member.

The interior surfaces of the casing members may be readily machined due to the geometry of the members. In particular, the casing member which incorporates the discharge branch may be machined by simple turning operations because the internal surfaces are all surfaces of revolution. The other casing member which incorporates the volute can be designed in such a way as to allow its complete machining using a conventional 2-axis machining center.

BRIEF DESCRIPTION OF THE DRAWINGS

Centrifugal pumps will now be described by way of example with reference to the accompanying drawings in which.

DETAILED DESCRIPTION OF THE PREFERRED EMBODIMENT

Figure 1:
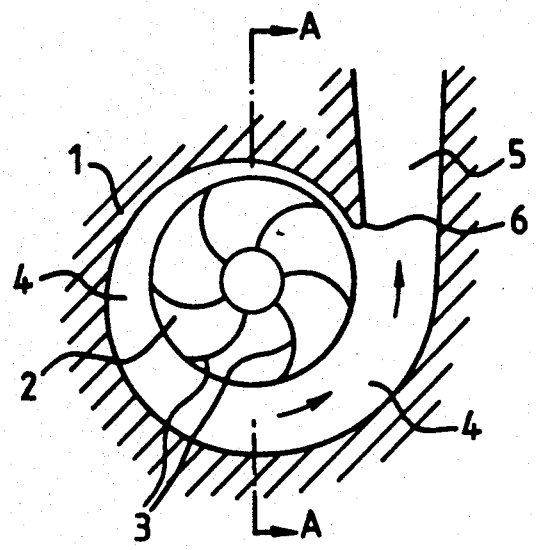
FIG. 1 shows a partially sectioned view of a conventional centrifugal pump from the inlet side

In FIG. 1 the centrifugal pump 1 has an impeller 2 which rotates in the direction of the arrows. Liquid from an inlet (shown in FIG. 2) impinges on the center of the impeller 2 and is forced, by the vanes 3 of the impeller 2, to the periphery of the interior of the pump 4 known as the volute. The volute 4 is shaped in such a manner that the flow area increases circumferentially until it merges into a discharge branch 5 so that the fluid is transported smoothly, due to hydraulic forces, out of the discharge branch 5. Where the innermost wall of the discharge branch 5 meets the inside wall of the pump 1 there is a discontinuity known as the cut water 6 or volute tongue.

Figure 2:
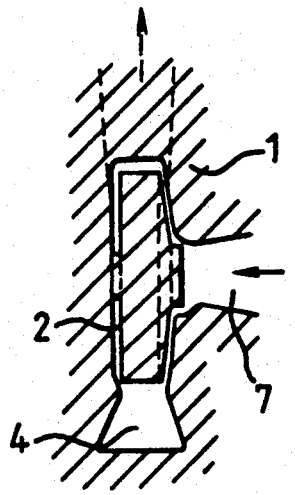
FIG. 2 shows the sectional view along line A—A of FIG. 1, together with the section through the inlet of the pump.

In FIG. 2 the arrows show the direction of the liquid into the pump 1, through the inlet 7, and out of the pump 1, through the discharge branch 5 (shown in dotted lines).

The pump shown in FIGS. 1 and 2 has a volute 4 which is positioned radially outwards from the impeller 2, and which is symmetrically-shaped about the line through the center of the impeller 2 in a direction transverse to the axis of the impeller 2.

Figure 3:
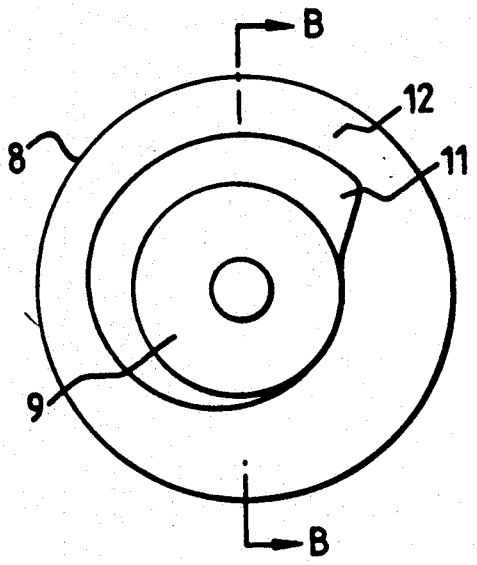
FIG. 3 shows a plan view of one part of a first embodiment of a pump of the present invention.
Figure 4:
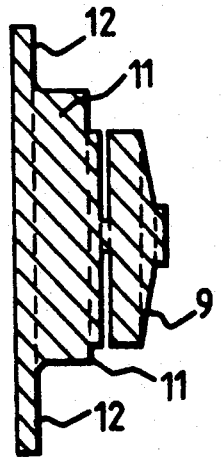
FIG. 4 shows the sectional view along lines B—B of FIG. 3.

FIG. 3 shows a first circular casing member 8 of a pump with a centrally mounted impeller 9. The impeller 9 is mounted on a raised section 11 on a flat base 12 of the member 8. The raised section 11 has a radius which varies circumferentially about the center of the member 8. FIG. 4 shows the member 8 and the impeller 9 in cross-section which shows the shape of the raised section 11 on the flat base 12.

Figure 5:
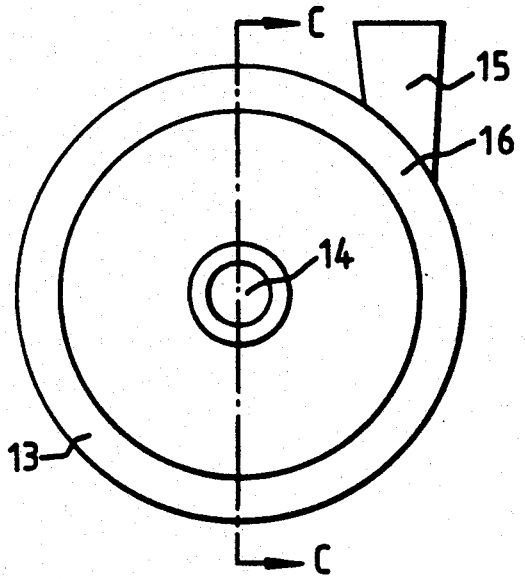
FIG. 5 shows a plan view of the other part of the pump of FIG. 3.
Figure 6:
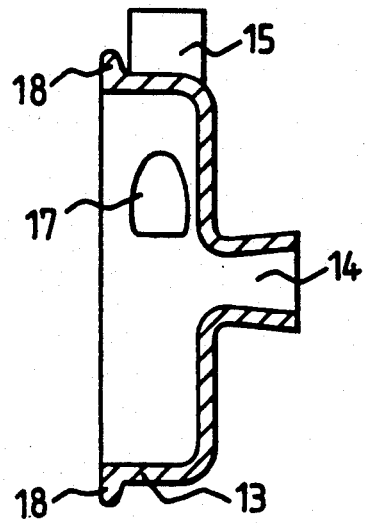
FIG. 6 shows the sectional view along the line C—C of FIG. 5.

FIG. 5 shows a second circular casing member 13 with an inlet 14 at the center of the second member 13. A discharge branch 15 is shown extending tangentially from the periphery 16 of the second member 13. FIG. 6 shows the second member 13 in cross-section which shows the inlet 14 and the opening 17 to the discharge branch 15. The second member 13 has a flange 18 which extends from the periphery 16 of the second member 13.

The two casing members 8 and 12 are brought together to provide a seal between the flange 18 and base 12, and the shape of the raised section 11 causes the flow area to change from a maximum to a minimum at the discharge branch 15. The radius of the section 11 increases circumferentially in a spiral-shape from a minimum to a maximum adjacent to the cut water 6 and then the radius decreases abruptly back to the minimum. The minimum radius may coincide with that of the impeller periphery.

Figure 7:
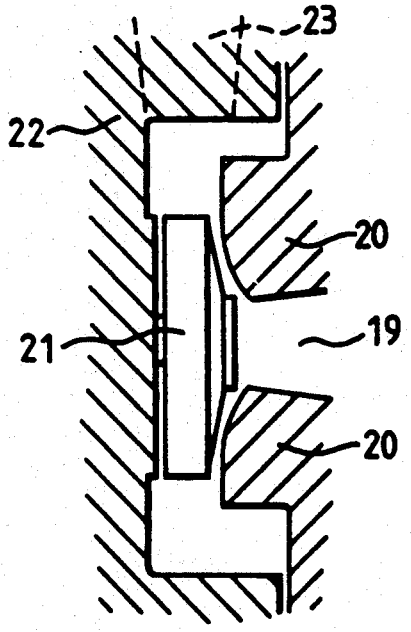
FIG. 7 shows a partially sectioned view of a second embodiment of a pump of the present invention.

FIG. 7 shows a second embodiment of a centrifugal pump in which an inlet 19 is in a casing member 20 which determines the shape of the volute. An impeller 21 is centrally mounted on the other casing member 22 which incorporates a discharge branch 23 (shown in dotted lines).

Figure 8:
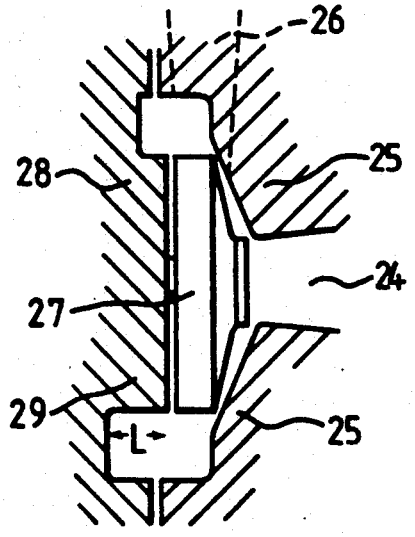
FIG. 8 shows a partially sectioned view of a third embodiment of a pump of the present invention.

FIG. 8 shows a third embodiment of centrifugal pump in which an inlet 24 is in the casing member 25 incorporating a discharge branch 26 (shown in dotted lines), and an impeller 27 is centrally mounted on a second casing member 28. In this embodiment the shape of the volute varies circumferentially within the pump due to the variation in the length "L" of a raised section 29 on the second member 28, in the direction of the axis of the impeller 27.

The centrifugal pumps of the present invention have the advantages of ease of manufacture and construction. This is due to the shapes of the casing members which form the pumps. It is particularly important to have good internal surface finishes, especially where the pump is to be used in the food industry for pumping edible and potable products. It will be noted that the raised sections of the second members that come into contact in use with the products are easily accessible to cutting and forming tools during manufacture using a relatively simple machining center. The described pumps are significantly more efficient than comparable prior art pumps. Further, it will be noted that the performance or capacity of the pump can be changed by altering the volute capacity and form but using the same one casing member such as members 13 or 22. Thus, the one casing member may be used for a range of pumps if desired.

While the invention has been described in connection with a preferred embodiment, it is not intended to limit the invention to the particular form set forth, but, on the contrary, it is intended to cover alternatives, modifications, and equivalents, as may be included within the spirit and scope of the invention as defined by the appended claims

I claim:

1. A centrifugal pump comprising a casing having an inlet and a discharge branch, and an impeller rotatably mounted within said casing to pump material from said inlet and through said discharge branch, said casing comprising first and second members which define between them a volute within which said impeller rotates, wherein said second casing member has a circular inner peripheral wall defining an outer periphery of said volute and said discharge branch is formed in said wall, and said first casing member is shaped so as to define with said inner peripheral wall said volute whose flow area varies circumferentially about said impeller, wherein said first member has a centrally positioned raised member which projects within a space defined by said circular wall, the radius of said first member varying circumferentially.

2. A centrifugal pump of the type comprising an impeller which rotates within a volute, and an inlet and a discharge branch communicating with said volute, wherein said volute is defined by first and second casing members, said second casing member having a circular inner peripheral wall which surrounds said impeller and defines an outer periphery of said volute, and said first casing member being shaped so as to define with said inner peripheral wall of said second casing member said volute having a flow area which increases towards said discharge branch, wherein said second casing member comprises an inner wall extending transversely of the axis of rotation of said impeller and of the axis of said circular inner peripheral wall, and said first casing member comprises an inner wall facing said inner wall of said second casing member, said first casing member inner wall having formed thereon a raised section which projects within the volume defined by said circular inner peripheral wall and is asymmetric about said axis of said circular inner peripheral wall, thereby to define a flow area which varies circumferentially about said impeller.

* * * * *